US005933900A

United States Patent [19]

Wang

[11] Patent Number: 5,933,900

[45] Date of Patent: Aug. 10, 1999

[54] MODULAR FLOOR CLEANING MACHINE

[76] Inventor: Xiao Chun Wang, 2810 Eaglecrest Pl., Diamond Bar, Calif. 91765

[21] Appl. No.: 08/864,957

[22] Filed: May 28, 1997

[51] Int. Cl.[6] ..... A47L 11/03; A47L 11/292

[52] U.S. Cl. ..... 15/50.3; 15/51; 15/99; 15/52.1

[58] Field of Search ..... 15/4, 50.3, 51, 15/52.1, 99

[56] References Cited

U.S. PATENT DOCUMENTS

| | | | |
|---|---|---|---|
| 557,377 | 3/1896 | Gee et al. | 15/51 |
| 1,229,648 | 6/1917 | Olander | 15/51 |
| 1,430,090 | 9/1922 | Lence | 15/51 |
| 1,522,133 | 1/1925 | Labiga et al. | 15/51 |
| 1,813,026 | 7/1931 | Coole | 15/51 |
| 2,088,246 | 7/1937 | Nelson | 15/51 |
| 2,153,686 | 4/1939 | Deegan, Sr. | 15/51 X |
| 2,268,073 | 12/1941 | Hunn et al. | 15/99 |

FOREIGN PATENT DOCUMENTS

| | | | |
|---|---|---|---|
| 184821 | 5/1907 | Germany | 15/52.1 |
| 6198 | 3/1912 | United Kingdom | 15/51 |

*Primary Examiner*—Mark Spisich
*Attorney, Agent, or Firm*—Sheldon & Mak

[57] ABSTRACT

Apparatus for cleaning a floor surface includes a chassis having a frame, an elevator mechanism, and a plurality of ground-contacting wheels; a tank supported by the chassis for holding a quantity of cleaning liquid; a sweeper module removably connectable to the chassis; and a carpet belt member. A plurality of laterally oriented rollers are supported by the chassis for supporting the carpet belt member in a closed path, including a cleaning roller for submerging a portion of the carpet belt within the tank, first and second wringer rollers, first and second press rollers, an adjustment roller for tensioning the carpet roller, an idler roller, and a drive roller. An insert member is supported by the chassis, the cleaning roller and the press roller being supported by the insert member. A main handle pivotally mounted to the insert member manipulates the apparatus on the floor surface. A roller drive rotatably couples the drive roller to at least one of the wheels for regulating a rate of advancement of the carpet belt during longitudinal movement of the apparatus. A platen member supported proximate the bottom extremity of the chassis between the idler and drive rollers for pressing the carpet belt against the floor surface in the at least one operating position of the elevator mechanism. Also disclosed is a method for cleaning a floor surface.

15 Claims, 5 Drawing Sheets

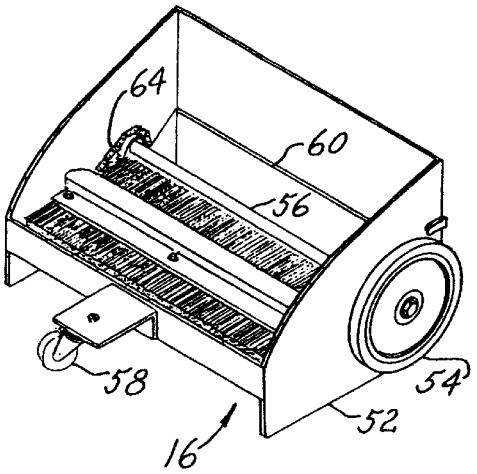
Fig. 5.
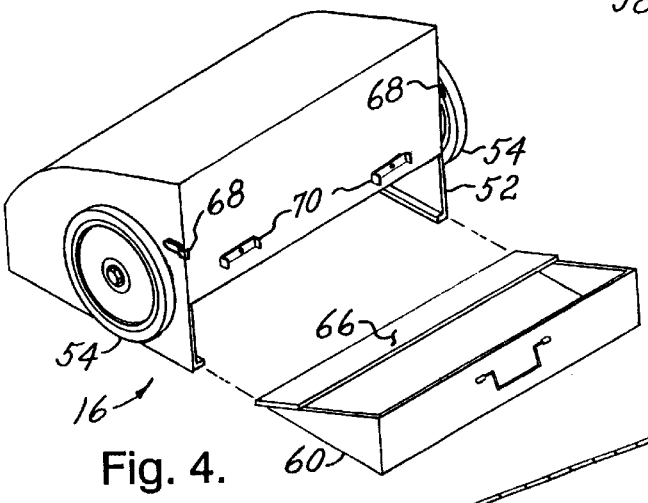
Fig. 4.
Fig. 3.
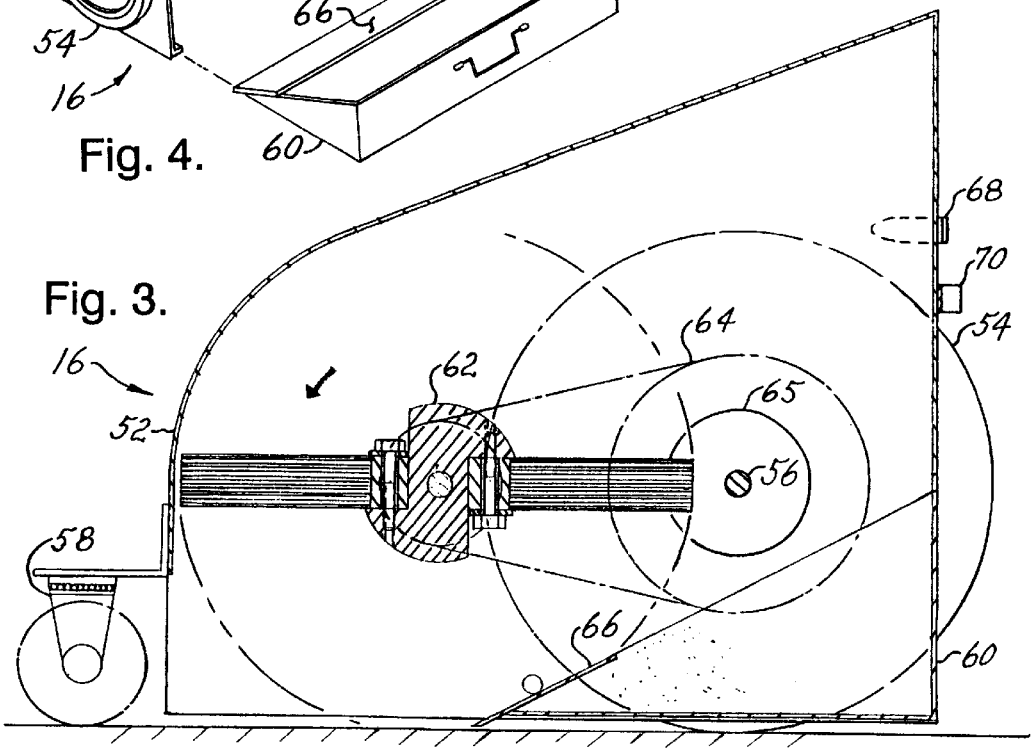

MODULAR FLOOR CLEANING MACHINE

BACKGROUND

The present invention relates to floor cleaning devices, and more particularly to devices for cleaning hard floor surfaces such as concrete, wood, and polyvinylchloride (PVC).

Although various types of floor cleaning devices are known and used, they are not entirely satisfactory for a variety of reasons. Hand-operated devices such as brooms and mops, although being generally effective and inexpensive to provide, are labor intensive and thus expensive to use. Also in the prior art are electrically powered cleaning machines that have motor-driven brush disks. These machines exhibit one or more of the following disadvantages:

1. They lack versatility, being made for concrete and marble-like surfaces they cannot be used on vinyl coverings; also they are made for specific operations such as sweeping or washing, requiring separate passes to be made with different devices; further, they are unable to remove water and require intervening manual mopping operations between washing and polishing; moreover, they require a source of electrical power, being subject to the dangers of electrical shock particularly during washing operations;
2. They are ineffective in reaching under low cabinet overhangs;
3. They are difficult to maneuver; and
4. They are excessively complex and consequently unreliable and expensive to provide.

Thus there is a need for a floor cleaning device that is effective on a variety of surfaces including concrete, that is easy to maneuver, that can reach under low obstacles, that can remove water, that can provide multiple functions such as sweeping and washing in a single pass, and that is reliable and inexpensive to provide.

SUMMARY

The present invention meets this need by providing a modular floor cleaner apparatus that is particularly effective for sweeping and washing, and that can wash close to a vertical obstruction that is under a low overhang. In one aspect of the invention, the apparatus includes a chassis having a frame and a plurality of ground-contacting wheels, at least some of the wheels being connected to the frame by an elevator mechanism having a plurality of operating positions for rollably supporting the frame at a corresponding plurality of distances above the floor surface; a tank supported by the chassis for holding a quantity of cleaning liquid; a carpet belt member, opposite ends of the belt member being connected for forming a closed loop of approximately uniform width; a plurality of laterally oriented rollers rotatably supported by the chassis for supporting the carpet belt member in a closed path, a portion of the closed path producing frictional contact between the belt member and the floor surface in at least one of the operating positions of the elevator mechanism, the belt member being lifted clear of the floor surface in an uppermost of the operating positions, the rollers including a cleaning roller for submerging a portion of the carpet belt within the tank, a wringer roller located vertically above the cleaning roller for directing the carpet belt out of the tank, a press roller biasingly located proximate the wringer roller opposite the carpet belt for squeezing liquid from the belt, and an idler roller located proximate a bottom extremity of the chassis; a main handle supported relative to the chassis for manipulating the apparatus on the floor surface; and a roller drive for rotatably coupling at least one of the rollers to at least one of the ground-contacting wheels for regulating a rate of advancement of the carpet belt during longitudinal movement of the apparatus when the elevator mechanism is in the at least one operating position.

The idler roller can be located for defining a forward extremity of the closed path, the rollers further including a drive roller to which the roller drive is coupled, the drive roller being located proximate the bottom extremity of the chassis and for defining a rearward extremity of the closed path. The apparatus can further include a platen member supported proximate the bottom extremity of the chassis between the idler and drive rollers for pressing the carpet belt against the floor surface in the at least one operating position of the elevator mechanism. A bottom surface of the tank can form at least a portion of the platen member.

Preferably the closed path of the carpet belt slopes upwardly and rearwardly from the idler roller, an outside contour of the chassis correspondingly sloping and enclosing the sloping path portion in proximity thereto for permitting cleaning access under a low overhanging obstruction.

The wringer roller can be a first wringer roller, the press roller being a first press roller, the rollers further including a second wringer roller located longitudinally opposite the cleaning roller from the first wringer roller, and a second press roller biasingly located proximate thereto, whereby the combination of the first and second wringer and press rollers is operative for squeezing liquid from the carpet belt on opposite sides of the cleaning roller. The rollers can further include an adjustment roller biasingly located for tensioning the carpet roller.

The apparatus can further include an insert member removably supported by the chassis, the cleaning roller and the press roller being supported by the insert member, whereby the carpet belt is released from the closed path upon removal of the insert member. Preferably the main handle can be pivotally mounted to the insert member for movement between longitudinal and lateral orientations. The main handle can include a T-shaped handle member having a column portion and an arm portion, the column portion being rotatably connected on a column axis thereof for permitting horizontal orientation of the arm portion in the longitudinal and lateral orientations of the handle.

Preferably the at least some wheels connected to the elevator mechanism are pivotable elevator caster wheels for facilitating lateral and turning movements as well as longitudinal movements of the apparatus when the elevator mechanism is in the uppermost operating position. The elevator mechanism can include a pair of four-bar linkage mechanisms on opposite sides of the chassis, each of the four-bar mechanisms including a main bar and a pair of connector bars pivotally connected between the main bar and a frame of the chassis, the elevator caster wheels being mounted to each of the main bars. Preferably the elevator mechanism has at least three operating positions, including first and second lowered positions in which the carpet belt contacts the floor surface with different compressive interference for effective cleaning of a variety of floor surfaces. The apparatus can further include a sweeper module connectable to the chassis and having a housing, a pair of side wheels rotatably coupled to the housing, a brush assembly rotatably supported within the housing and rotatably coupled to at least one of the side wheels for brushing the floor surface when the elevator mechanism is in the at least one operating position, and a tray member removably supported within the housing for collecting particles brushed from the floor surface. The sweeper module can be removably connected to the chassis, the sweeper module further including a sweeper caster for rollably supporting the housing in combination with the side wheels when the sweeper module is removed from the chassis.

In another aspect of the invention, a method for cleaning a floor surface includes the steps of:

(a) providing a wheeled chassis having a carpet belt movable in a closed path that extends within a tank, and an elevator mechanism for selectively locating the path in contact with the floor surface and raised from the floor surface;

(b) feeding a cleaning liquid into the tank;

(c) raising the path from the floor surface;

(d) rolling the chassis to a desired location and orientation on the floor surface;

(e) lowering the path into contact with the floor surface;

(f) advancing the chassis while simultaneously sliding the carpet belt along the floor surface and advancing the carpet belt in the closed path;

(g) progressively rinsing the carpet belt with the cleaning liquid; and (h) progressively squeezing liquid from the carpet belt.

The method can include the further step of sweeping the floor surface simultaneously with the step of advancing the chassis.

The floor cleaner apparatus of the present invention provides significant advantages over existing devices by both washing and drying a variety of floor surfaces including concrete and vinyl, that is all floor surfaces other than carpeting. Three to five laborers that would otherwise be required are free to do other work.

DRAWINGS

These and other features, aspects, and advantages of the present invention will become better understood with reference to the following description, appended claims, and accompanying drawings, where:

FIG. 3 is a fragmentary longitudinal sectional view of a sweeper module of the machine of FIG. 1;

FIG. 4 is a left rear perspective view of the sweeper module of FIG. 4, showing a collection tray thereof removed therefrom;

FIG. 5 is a left front perspective cut-away view of the module of FIG. 3;

DESCRIPTION

Figure 8:
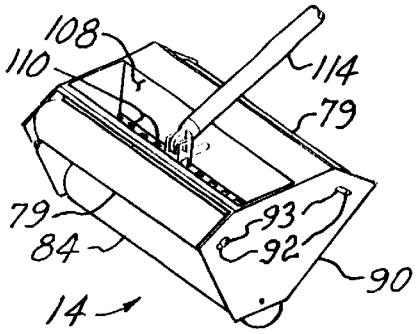
FIG. 8 is a left front perspective view of a roller insert portion of the main module of FIG. 2.
Figure 12:
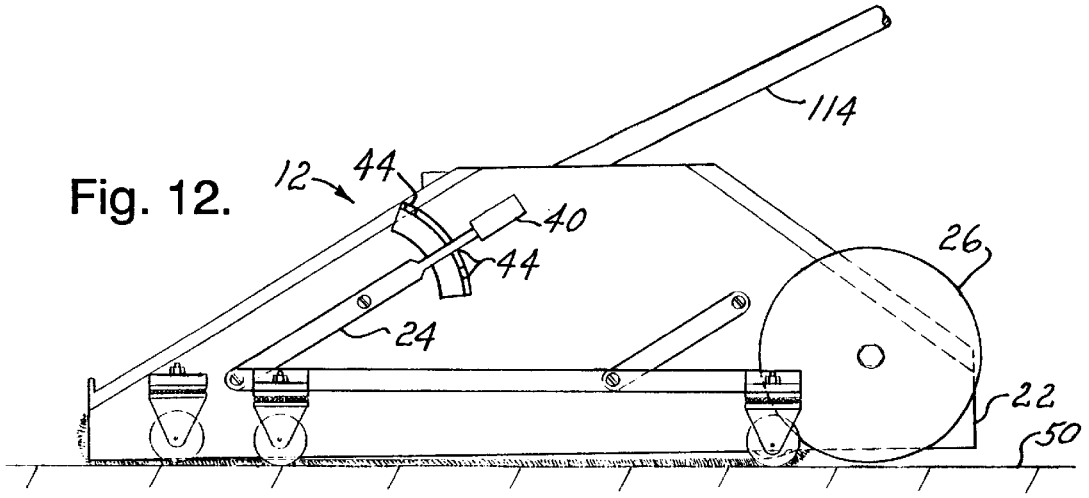
FIG. 12 is an elevational view as in FIG. 11, showing the module in a first lowered condition.

The present invention is directed to a modular floor cleaning machine that is particularly versatile for sweeping and washing in confined spaces. With reference to FIGS. 1–13 of the drawings, a floor cleaning machine 10 includes a main module 12 (FIG. 2) having a removable roller insert 14 (FIG. 8), a sweeper module 16 (FIGS. 3–5), and a trash bin module 18 that is connectable between the main module 12 and the sweeper module 16. The main module 12 includes a chassis 20 having a main frame 22, an elevator mechanism 24, a pair of main wheels 26, and a cleaning or carpet belt 28 that is driven on a plurality of rollers as described below. The elevator mechanism 24 includes a pair of 4-bar linkages 30 that are connected on opposite sides of the main frame 22 by a pair of cross-shafts 32 that are sometimes individually referred to as first cross-shaft 32A and second cross-shaft 32B, at least one of the cross-shafts 32 being pivotally connected to the frame 22 by suitable bearings (not shown). Each of the four-bar linkages 30 includes a main bar 34 having a longitudinally spaced pair of elevator casters 36 mounted thereto, and a spaced pair of connector bars 38 that are connected on opposite sides of the main frame 22 by respective ones of the cross-shafts 32 and to respective longitudinally spaced locations on the corresponding main bar 34. An elevator handle 40 forms an extension of one of the connector bars 38, the handle 40 being formed with a blade portion 42 that is selectively engagable with a plurality of slots 44 that are formed in an index member 46 for locking the elevator mechanism 24 in a desired vertical relationship with the main frame 22, the index member 46 being rigidly mounted on the main frame 22. In the exemplary configuration of the machine 10 as shown in the drawings, opposite ends of the first cross-shaft 32A are formed for rigid connection to the corresponding connector bars 38 using suitable fasteners 48, the first cross-shaft 32A being located forwardly of the second cross-shaft 32B and in association with the index member 46. As further shown in the drawings, the casters 36 are swivel casters for omnidirectional rolling support of the machine 10 on a floor surface 50 when the elevator mechanism 24 is locked in a transporting position as shown in FIG. 11. As further described below, the elevator mechanism 24 is also selectively lockable in first and second cleaning positions, the first cleaning position being shown in FIGS. 2 and 12, the second cleaning position being shown in FIGS. 1, 6, 9, and 13.

Figure 1:
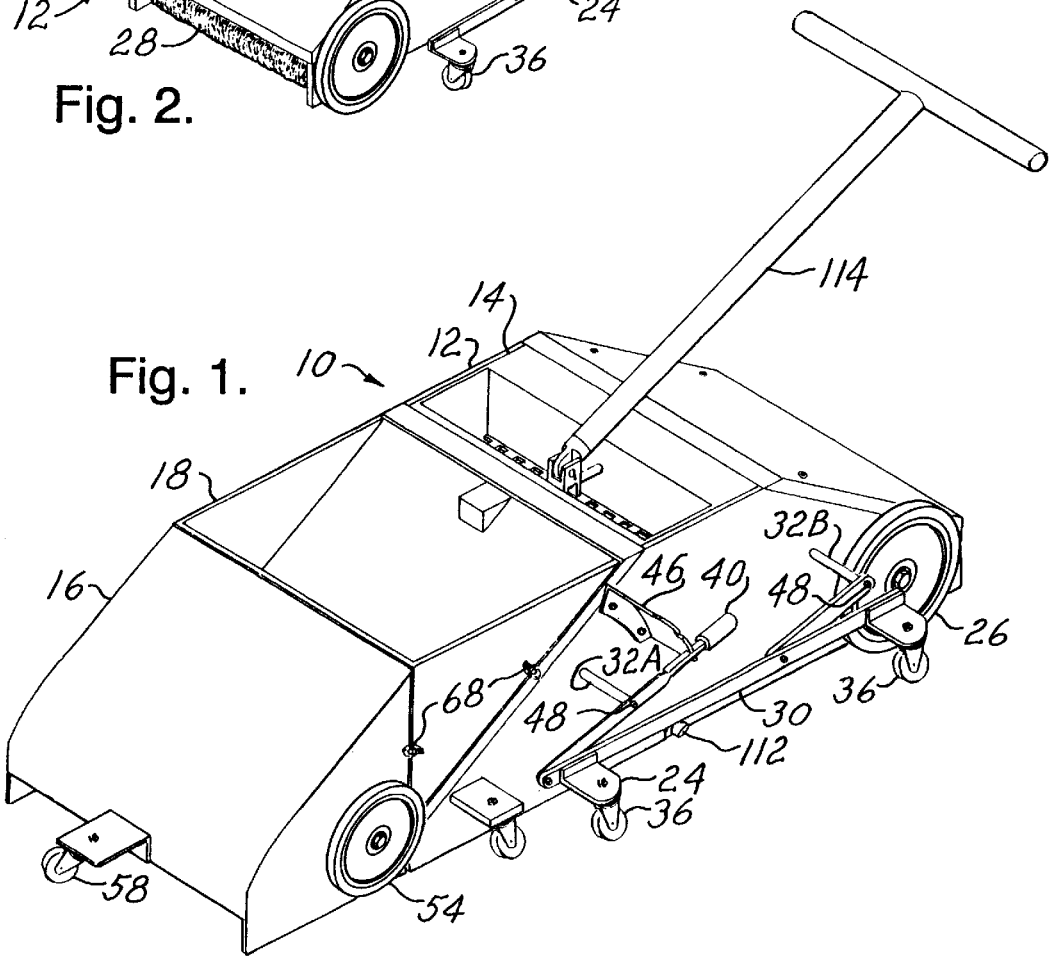
FIG. 1 is a left front perspective view of a modular floor cleaning machine according to the present invention.

The sweeper module 16 includes a housing 52 having a pair of side wheels 54 rotatably connected thereto by a sweeper axle 56, and a front caster 58, for rollably supporting the housing 52 on the floor surface 50 when the sweeper module 16 is disconnected from the rest of the machine 10 as shown in FIGS. 3–5, at least the side wheels 54 contacting the floor surface 50 when the sweeper is connected as shown in FIG. 1, the elevator mechanism 24 being in the second cleaning position. The sweeper module 16 further includes a removable dust tray 60, a brush assembly 62 that is rotatably supported within the housing 52 on suitable bearings (not shown), and a brush drive 64. The brush drive 64 rotatably connects at least one of the side wheels 54 to the brush assembly 62 for driving the brush assembly 62 in the same direction as the side wheels 54 when the machine 10 is being advanced on the floor surface 50 with the elevator mechanism 24 in the second cleaning position. The brush drive 64 also includes a one-way clutch 65 on the sweeper axle 56 for permitting the brush assembly 62 to remain at rest when the machine 10 is moved rearwardly on the floor surface 50. As further shown in FIG. 5, the brush assembly 62 extends substantially across the full interior width of the housing 52, and the brush drive 64 is implemented as a chain drive from the sweeper axle 56, both side wheels 54 being preferably rigidly connected to the axle 56, the axle 56 also being rotatably mounted to the housing 52 on suitable bearings (not shown). The brush assembly 62 is located within the housing for sweeping dust from the floor surface 50, the dust being carried over a ramp surface 66 of the dust tray 60 and into the tray 60.

The sweeper module 16 is connected to the bin module by a pair of releasable latches 68, a pair of tab members 70 projecting from the housing 52 into corresponding slots 72 of the bin module 18 for maintaining alignment between the sweeper and bin modules 16 and 18.

Figure 6:
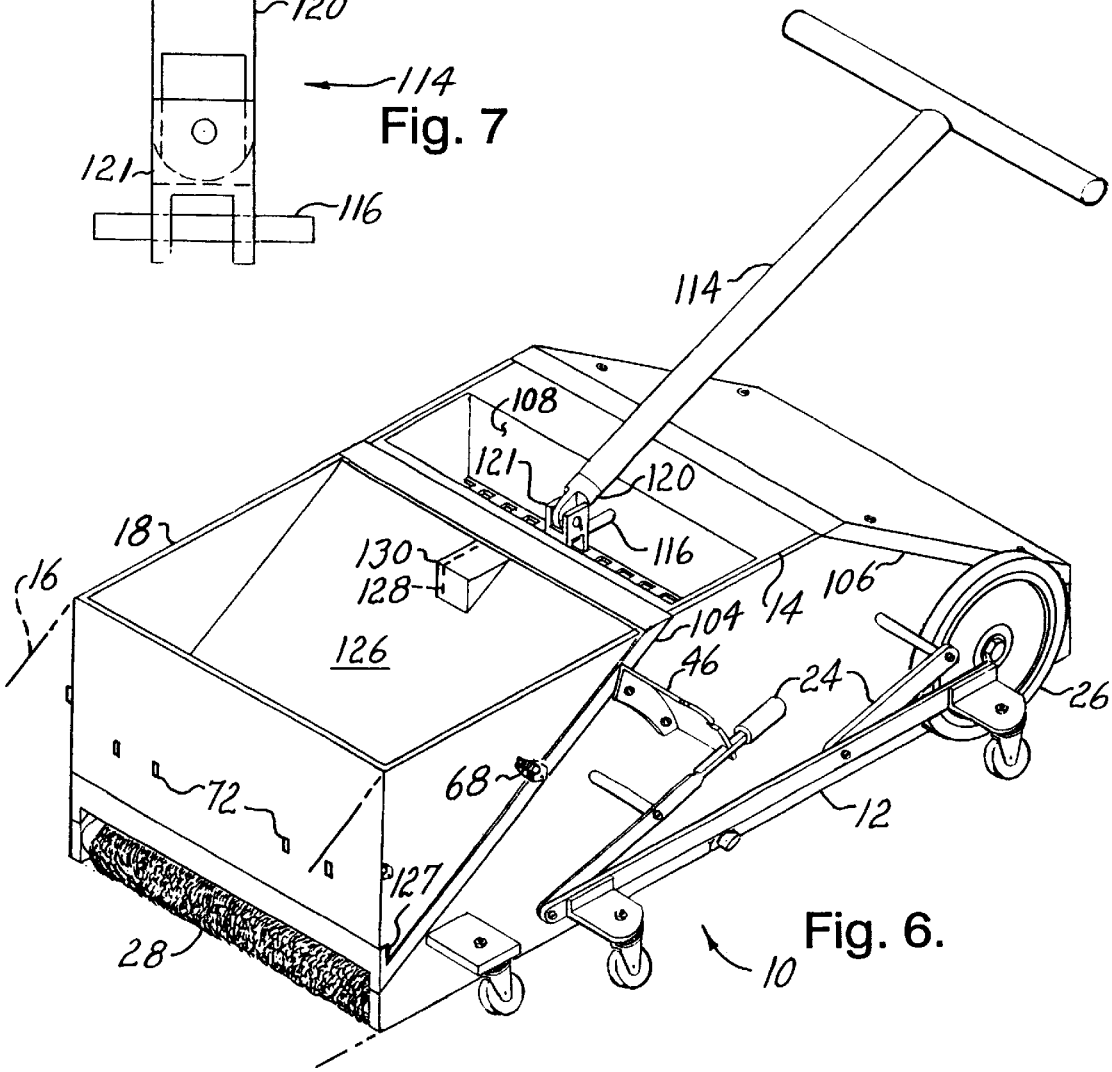
FIG. 6 is a left front perspective view showing the machine of FIG. 1 without the sweeper module of FIGS. 3–5.
Figure 9:
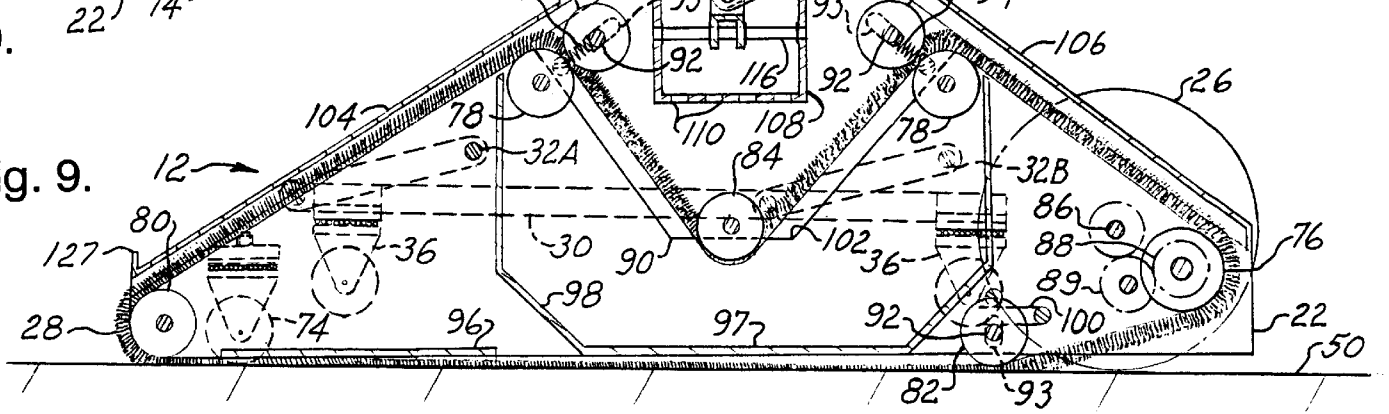
FIG. 9 is a fragmentary lateral sectional view of the main module of FIG. 2.
Figure 13:
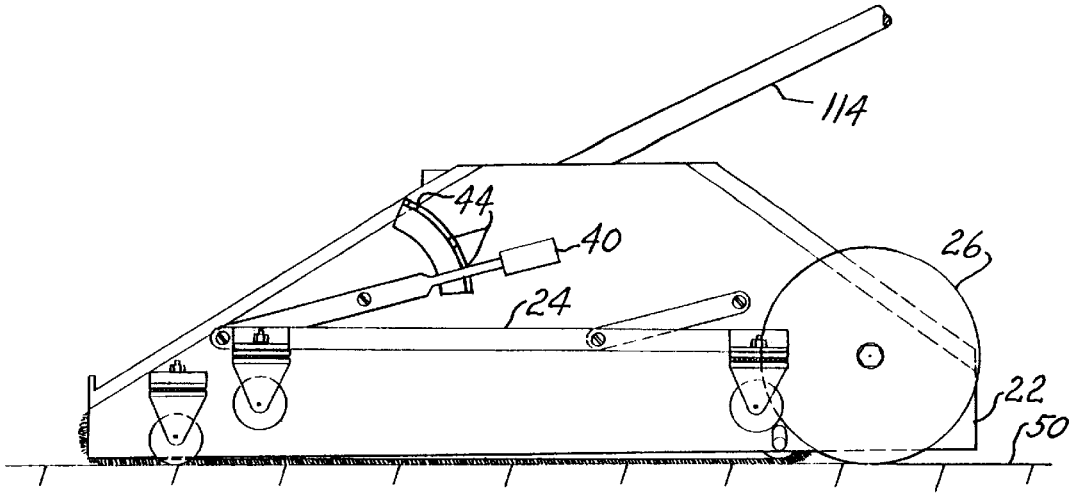
FIG. 13 is an elevational view as in FIG. 11, showing the module of FIG. 12 in a second lowered condition.

The chassis 20 is also provided with a pair of auxiliary casters 74 for supporting a front portion of the main module 12 when the elevator mechanism 24 is in the second cleaning position with the sweeper module 16 removed from the machine 10 as shown in FIGS. 6, 9, and 13. It will be understood that the function of the auxiliary casters 74 can be implemented by configuring the elevator mechanism to vertically locate the front and rear elevator casters 36 differently in each of the first and second cleaning positions. This can be accomplished, for example, by providing the connector bars 38 in unequal lengths, or by incorporating a cam mechanism.

Figure 10:
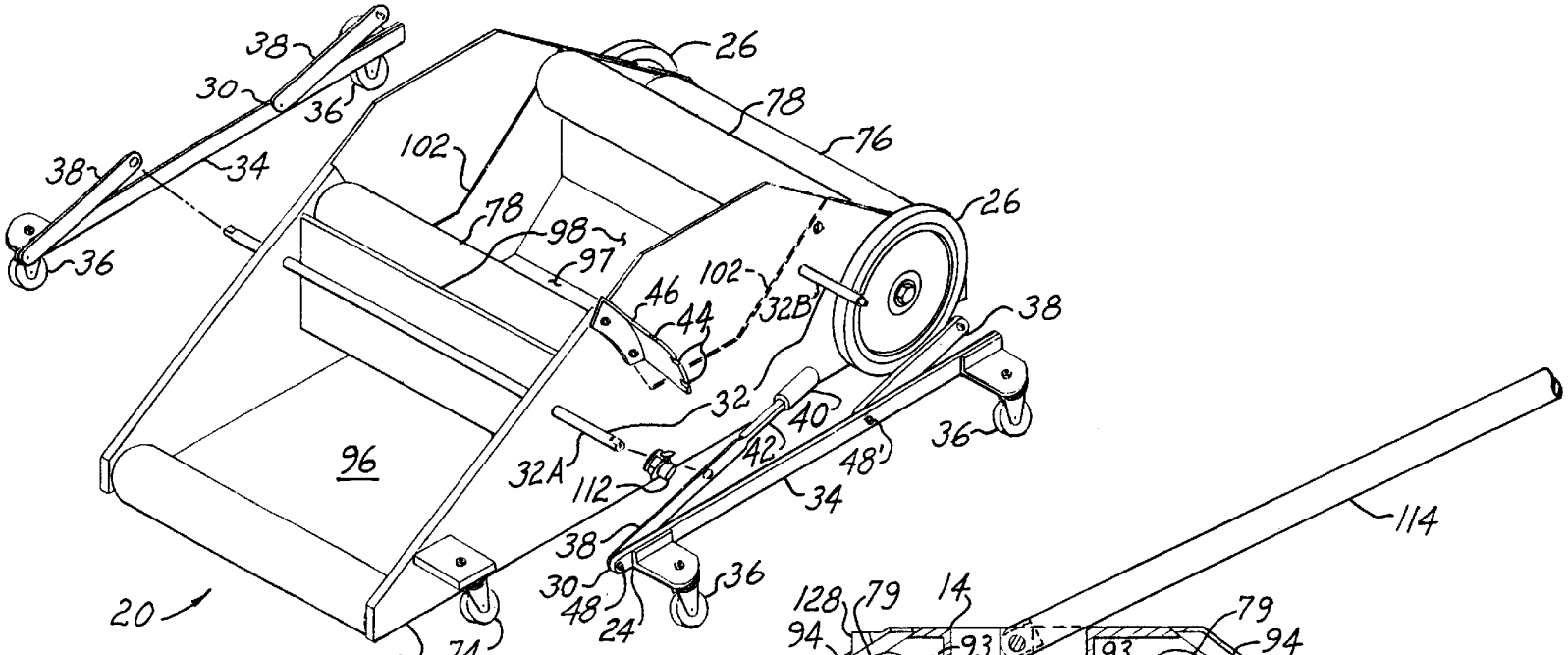
FIG. 10 is an exploded perspective view of a chassis portion of the main module of FIG. 2.
Figure 11:
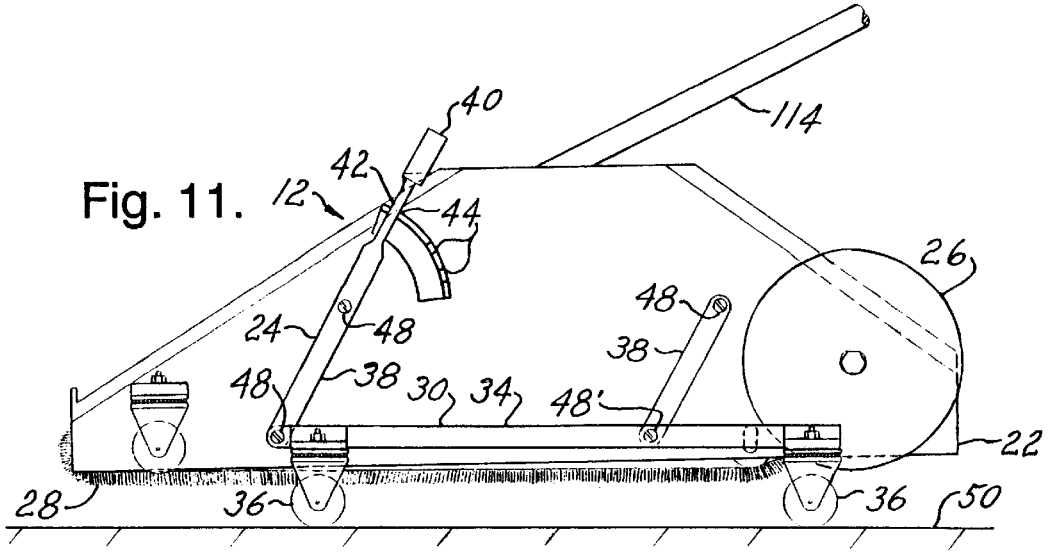
FIG. 11 is a left side elevational view showing the main module of FIG. 2 in an elevated transit condition.

As shown in FIGS. 9 and 10, the carpet belt 28 is supported within the main module 12 on a plurality of rollers, including a drive roller 76, a pair of wringer rollers 78, a pair of press rollers 79, an idler roller 80, an adjustment roller 82 and a cleaning roller 84. The drive roller 76 is rotatably coupled to a main axle 86 and thereby to the main wheels 26 by a gear train 88, the gear train 88 being implemented for producing rotation of the drive roller 76 in the same direction as the main wheels 26 by incorporating an idler gear 89 as shown in FIG. 9, or by other suitable means. The drive roller 76, wringer rollers 78, and the idler roller 80, as well as the main axle 86 and the idler gear 89, are rotatably connected at fixed locations on the main frame 22 using suitable bearings (not shown). Similarly, the cleaning roller 84 is rotatably connected to a fixed location on an insert frame 90 of the roller insert 14. The press rollers 79 are rotatably and movably connected to the roller frame 90 on respective roller shafts 92, opposite ends of each roller shaft 92 projecting into corresponding guide slots 93 of the insert frame 90 for guidance of the respective roller 79 into proximity with a corresponding one of the wringer rollers 78. Pairs of tension springs 94 that are anchored on the insert frame are also connected proximate opposite ends of the roller shafts 92 for biasingly clamping opposite sides of the carpet belt 28 between the wringer rollers 78 and the press rollers 79, thereby squeezing cleaning liquid therefrom, the carpet belt 28 being submersed in liquid by the cleaning roller 84 as described below.

The carpet belt 28 is tensioned about the drive roller 76 and the idler roller 80, extending from the drive roller 76 over one of the wringer rollers 78, being compressed thereon by the corresponding press roller 79, the belt 28 then passing under the cleaning roller 84, between the other of the wringer and press rollers 78 and 79, to the idler roller 80, and from there under first and second platen members 96 and 97 and the adjustment roller 82, back to the drive roller 76, thereby completing a closed path. The carpet belt 28 can be formed of a strip of flexible material such as rubber and having nylon bristles extending therefrom, the bristles having sufficient length and stiffness for repeatably compressing approximately 0.5 inch when being pressed against the floor surface. In a preferred implementation, the bristles of the carpet belt 28 have a texture corresponding to conventional pile carpeting. Opposite ends of the strip are connected in any suitable manner permitting continuous closed path movement over the rollers. The platen members 96 and 97 are rigidly connected between opposite sides of the main frame 22 proximate lower extremities thereof for pressing the carpet belt 28 against the floor surface 50 as the machine 10 is advanced with the elevator mechanism in the first or second lowered positions as described above. The second platen member 97 also forms a bottom wall of a tank 98 into which the cleaning roller 84 extends for progressively wetting and rinsing the carpet belt 28, the tank 98 extending to proximate the carpet belt 28 on opposite sides of the wringer rollers 78 for collecting liquid being squeezed from the belt 28. The adjustment roller 82 is movably supported on another of the roller shafts 92 by counterparts of the guide slots 93, being biased downwardly against the carpet belt 28 by a pair of lever springs 100. In the exemplary configuration of the machine 10 as shown in the drawings, a suitable width of the carpet belt 28 is from approximately 15 inches to approximately 20 inches, the belt 28 having a circumferential length of approximately 76 inches.

The insert frame 90 of the roller insert 14 nests within the main frame 22 by engaging opposite side cavities 102 thereof, the roller insert 14 being retained within the main module 12 by respective sloping front and rear cover panels 104 and 106 of the chassis 20 that are removably fastened to the main frame 22 by any suitable means. The insert frame 90 includes a body portion 108 that extends downwardly between the press rollers 79. As further shown in FIG. 9, the body portion 108 has a plurality of openings 110 formed therein through which the tank 98 can be filled, the tank 98 also having a drain fitting 112 as shown in FIG. 10, the body portion 108 also supporting a main handle assembly 114 by which the machine 10 can be moved about on the floor surface 50.

Figure 7:
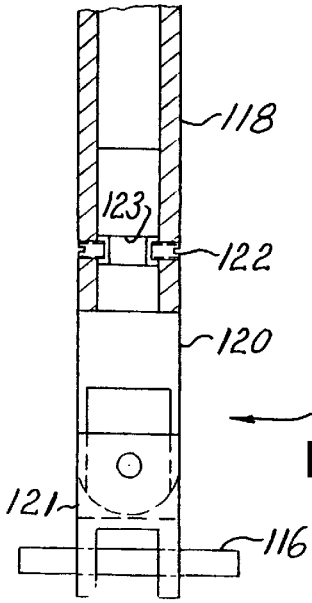
FIG. 7 is a fragmentary sectional detail view of a handle portion of the machine of FIG. 1.

The main handle assembly 114 includes a longitudinal pivot shaft 116 that engages opposite walls of the body portion 108, a T-shaped handle member 118, a swivel coupling 120 and a universal pivot member 121 as shown in FIG. 7. The swivel coupling 120 extends axially within the handle member 118, being axially retained by a pair of threaded pins 122 that project through the handle member 118 and loosely into a circular groove 123 of the swivel coupling 120. The swivel coupling 120 is pivotally connected to the pivot member 121, the pivot member 121 being pivotally supported by the pivot shaft 116, the handle member 118 being freely movable from a rear-projecting orientation as shown in FIGS. 1, 6, 8, 9, and 11–13, to a side-projecting orientation as shown by solid lines in FIG. 2 (for laterally shifting the chassis 20 as indicated by the solid arrow therein), and a front-projecting position as shown by broken lines in FIG. 2 (the front- and rear-projecting orientations facilitating longitudinal movement as indicated by the broken arrow in FIG. 2).

Figure 2:
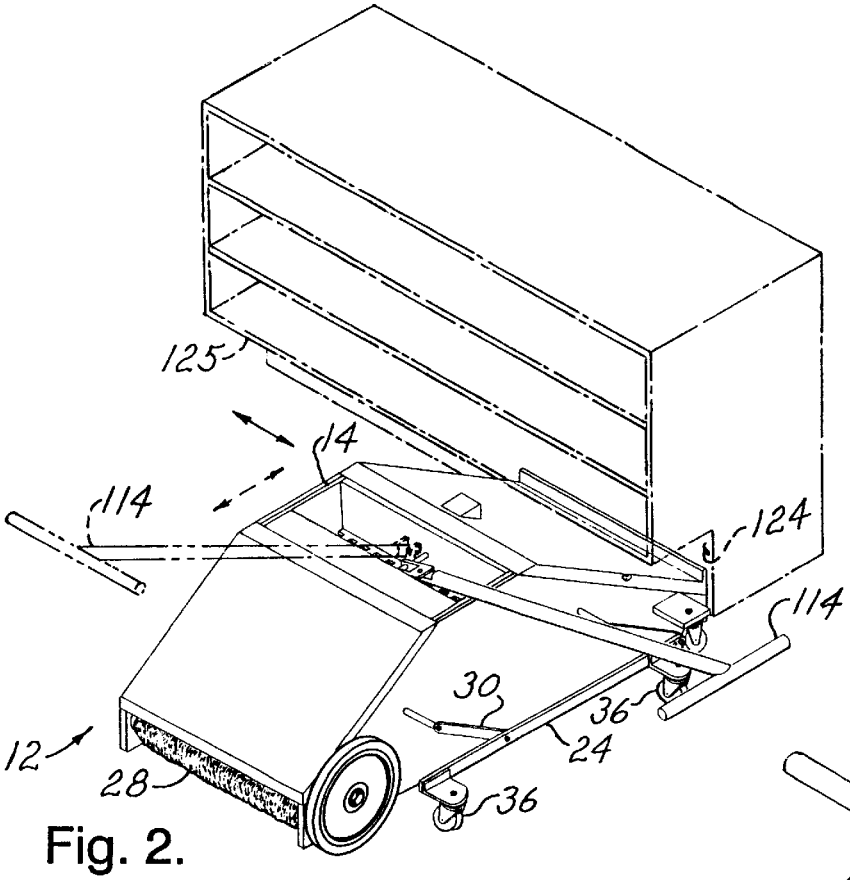
FIG. 2 is a right rear perspective view showing a main module of the machine of FIG. 1 in use reaching under cabinet overhang.

As further emphasized in FIG. 2, the front and rear cover panels 104 and 106 slope upwardly from the respective idler and drive rollers 80 and 76 to the body portion 108 of the insert frame 90, covering corresponding sloping portions of the carpet belt 28 in proximity thereto. Thus the main module 12 is operable for reaching proximate a vertical wall surface 124 that is behind a low overhanging obstruction 125.

The trash bin module 18 includes a bin member 126 and counterparts of the fasteners 68 for releasably connecting the bin member 126 to the front cover 104 of the main module 12. The front cover 104 is formed with an upwardly extending lip portion 127 at a lower extremity thereof for longitudinally supporting the bin member 126, and a boss portion 128, the boss portion 128 engaging a cavity portion 130 of the bin member 126 for laterally registering the bin module 18 on the front cover 104.

In use, a suitable cleaning fluid is poured into the tank 98 through the openings 110, to a level that is preferably no higher than the openings 110 (about 2 inches below the top of the tank 98). The elevator mechanism is indexed in the raised position as shown in FIG. 11, and the machine 10 is manipulated as desired to a portion of the floor surface 50 to be cleaned. Then the elevator mechanism 24 is moved to the second lowered position as shown in FIG. 13, and the machine 10 is moved longitudinally with the handle assembly 114 forwardly or rearwardly disposed as shown in FIG. 1 and the,broken lines in FIG. 2. The carpet belt 28 then makes sliding contact with the floor surface 50 as regulated by the main wheels 26 through the gear train 88. For example, with the drive roller 76 having a diameter approximately 30 percent of the diameter of the main wheels and the gear train 88 having a ratio of 1:1, the carpet belt moves relative to the main frame 22 at approximately 30 percent of a peripheral velocity of the main wheels 26. Thus the carpet belt makes sliding contact with the floor surface 50 at approximately 70 percent of a travel velocity of the machine 10 over the floor surface 50, provided that there is no significant slippage of the main wheels 26 on the floor surface 50. It will be appreciated that the intended sliding contact by the carpet belt 28 is attained with the frictional drag of the belt 28 within the main module 12 is less than the frictional drag between the carpet belt 28 and the floor surface 50, and the frictional engagement of the main wheels 26 with the floor surface is not less than 30 percent of the difference between the drag between the carpet belt 28 and the floor surface 50 and that within the main module 12. Periodically the tank 98 is drained and refilled for removing contamination that is rinsed from the carpet belt 28.

In the first lowered position of the elevator mechanism 24 (FIG. 12), a portion of the weight of the machine 10 is carried by the elevator casters 36 for reduced cleaning pressure, the main wheels 26 and the auxiliary casters 74 being raised approximately 0.125 inch above the floor surface 50. The reduced cleaning pressure of the first lowered position permits cleaning to be done with lateral translation of the machine 10 as shown by the solid lines in FIG. 2, the carpet belt 28 temporarily remaining stationary relative to the main frame 22 during such moves. In the second lowered position as shown in FIG. 13, the elevator casters 36 are lifted away from the floor surface 50, the full weight of the machine 10 being shared between the carpet belt 28 and the remaining wheels, including the main wheels 26, the auxiliary casters 74 and, when the sweeper module 16 is attached, the side wheels 54 and the front caster 58. It is expected that the presence of the sweeper module 16 has little effect on the weight borne by the carpet belt 28 in that the added weight of the sweeper module 16 is substantially balanced by the side wheels 54 and the front caster 58.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. Apparatus for cleaning a floor surface, comprising:

(a) a chassis having a frame and a plurality of ground-contacting wheels, at least some of the wheels being connected to the frame by an elevator mechanism having a plurality of operating positions for rollably supporting the frame at a corresponding plurality of distances above the floor surface;

(b) a tank supported by the chassis for holding a quantity of cleaning liquid;

(c) a carpet belt member, opposite ends of the belt member being connected for forming a closed loop of approximately uniform width;

(d) a plurality of laterally oriented rollers rotatably supported by the chassis for supporting the carpet belt member in a closed path, a portion of the closed path producing frictional contact between the belt member and the floor surface in at least one of the operating positions of the elevator mechanism, the belt member being lifted clear of the floor surface in an uppermost of the operating positions, the rollers including:

(i) a cleaning roller for submerging a portion of the carpet belt within the tank;

(ii) a wringer roller located vertically above the cleaning roller for directing the carpet belt out of the tank;

(iii) a press roller biasingly located proximate the wringer roller opposite the carpet belt for squeezing liquid from the belt; and (iv) an idler roller located proximate a bottom extremity of the chassis, the idler roller being located for defining a forward extremity of the closed path, the rollers further including a drive roller, the drive roller being located proximate the bottom extremity of the chassis and for defining a rearward extremity of the closed path;

(e) a main handle supported relative to the chassis for manipulating the apparatus on the floor surface; and (f) a roller drive for rotatably coupling the drive roller to at least one of the ground-contacting wheels for regulating a rate of advancement of the carpet belt during longitudinal movement of the apparatus when the elevator mechanism is in the at least one operating position.

2. The apparatus of claim 1, further comprising a platen member supported proximate the bottom extremity of the chassis between the idler and drive rollers for pressing the carpet belt against the floor surface in the at least one operating position of the elevator mechanism.

3. The combination of claim 2, wherein a bottom surface of the tank forms at least a portion of the platen member.

4. The combination of claim 1, wherein the closed path of the carpet belt slopes upwardly and rearwardly from the idler roller, an outside contour of the chassis correspondingly sloping and enclosing the sloping path portion in proximity thereto for permitting cleaning access under a low overhanging obstruction.

5. The apparatus of claim 1, wherein the wringer roller is a first wringer roller and the press roller is a first press roller, the rollers further including a second wringer roller located longitudinally opposite the cleaning roller from the first wringer roller, and a second press roller biasingly located proximate thereto, whereby the combination of the first and second wringer and press rollers is operative for squeezing liquid from the carpet belt on opposite sides of the cleaning roller.

6. The apparatus of claim 1, wherein the rollers further include an adjustment roller biasingly located for tensioning the carpet belt member.

7. The apparatus of claim 1, further comprising an insert member removably supported by the chassis, the cleaning roller and the press roller being supported by the insert member, whereby the carpet belt is released from the closed path upon removal of the insert member.

8. The apparatus of claim 7, wherein the main handle is pivotally mounted to the insert member for movement between longitudinal and lateral orientations.

9. The apparatus of claim 8, wherein the main handle comprises a T-shaped handle member having a column portion and an arm portion, the column portion being rotatably connected on a column axis thereof for permitting horizontal orientation of the arm portion in the longitudinal and lateral orientations of the handle.

10. The apparatus of claim 1, wherein the at least some wheels connected to the elevator mechanism are pivotable elevator caster wheels for facilitating lateral and turning movements as well as longitudinal movements of the apparatus when the elevator mechanism is in the uppermost operating position.

11. The apparatus of claim 10, wherein the elevator mechanism includes a pair of four-bar linkage mechanisms on opposite sides of the chassis, each of the four-bar mechanisms including a main bar and a pair of connector bars pivotally connected between the main bar and a frame of the chassis, the elevator caster wheels being mounted to each of the main bars.

12. The apparatus of claim 1, wherein the elevator mechanism has at least three operating positions, including first and second lowered positions in which the carpet belt contacts the floor surface.

13. The apparatus of claim 1, further comprising a sweeper module connectable to the chassis and having a housing, a pair of side wheels rotatably coupled to the housing, a brush assembly rotatably supported within the housing and rotatably coupled to at least one of the side wheels for brushing the floor surface when the elevator mechanism is in the at least one operating position, and a tray member removably supported within the housing for collecting particles brushed from the floor surface.

14. The apparatus of claim 13, wherein the sweeper module is removably connected to the chassis, the sweeper module further comprising a sweeper caster for rollably supporting the housing in combination with the side wheels when the sweeper module is removed from the chassis.

15. Apparatus for cleaning a floor surface, comprising:

(a) a chassis having frame and a plurality of ground-contacting wheels, at least some of the wheels being pivotable elevator caster wheels and being connected to the frame by an elevator mechanism having a plurality of operating positions for rollably supporting the frame at a corresponding plurality of distances above the floor surface for facilitating lateral and turning movements as well as longitudinal movements of the apparatus when the elevator mechanism is in the uppermost operating position, the elevator mechanism including a pair of four-bar linkage mechanisms on opposite sides of the chassis, each of the four-bar mechanisms including a main bar and a pair of connector bars pivotally connected between the main bar and the frame of the chassis, the elevator caster wheels being mounted to each of the main bars;

(b) a tank supported by the chassis for holding a quantity of cleaning liquid;

(c) a sweeper module removably connectable to the chassis and having a housing, a pair of side wheels rotatably coupled to the housing, a brush assembly rotatably supported within the housing and rotatably coupled to at least one of the side wheels for brushing the floor surface when the elevator mechanism is in the at least one operating position, and a tray member removably supported within the housing for collecting particles brushed from the floor surface (d) a carpet belt member, opposite ends of the belt member being connected for forming a closed loop of approximately, uniform width, the elevator mechanism having at least three operating positions, including first and second lowered positions in which the carpet belt contacts the floor surface;

(e) a plurality of laterally oriented rollers rotatably supported by the chassis for supporting the carpet belt member in a closed path, a portion of the closed path producing frictional contact between the belt member and the floor surface-in at least one of the operating positions of the elevator mechanism, the belt member being lifted clear of the floor surface in an uppermost of the operating positions, the rollers including:

(i) a cleaning roller for submerging a portion of the carpet belt within the tank;

(ii) a first wringer roller located vertically above the cleaning roller for directing the carpet belt out of the tank;

(iii) a second wringer roller located longitudinally opposite the cleaning roller from the first wringer roller;

(iv) a first press roller biasingly located proximate the first wringer roller opposite the carpet belt for squeezing liquid from the belt;

(v) a second press roller biasingly located proximate the second wringer roller, whereby the combination of the first and second wringer and press rollers is operative for squeezing liquid from the carpet belt on opposite sides of the cleaning roller;

(vi) an adjustment roller biasingly located for tensioning the carpet belt member;

(vii) an idler roller located proximate a bottom extremity of the chassis, the idler roller being located for defining a forward extremity of the closed path; and (viii) a drive roller located proximate the bottom extremity of the chassis and for defining a rearward extremity of the closed path;

(f) an insert member removably supported by the chassis, the cleaning roller and the press rollers being supported by the insert member, whereby the carpet belt is released from the closed path upon removal of the insert member;

(g) a main handle supported relative to the chassis for manipulating the apparatus on the floor surface, the main handle being pivotally mounted to the insert member for movement between longitudinal and lateral orientations; and (h) a roller drive for rotatably coupling the drive roller to at least one of the ground-contacting wheels for regulating a rate of advancement of the carpet belt during longitudinal movement of the apparatus when the elevator mechanism is in the at least one operating position; and (i) a platen member supported proximate the bottom extremity of the chassis between the idler and drive rollers fro pressing the carpet belt against the floor surface in the at least one operating position of the elevator mechanism.

* * * * *